US007188437B2

(12) United States Patent
Lee et al.

(10) Patent No.: US 7,188,437 B2
(45) Date of Patent: Mar. 13, 2007

(54) DRYING UNIT FOR WASHING MACHINES

(75) Inventors: Tae Hee Lee, Buchun-si (KR); Si Moon Jeon, Seoul (KR); Hyun Seok Seo, Inchun-si (KR)

(73) Assignee: LG Electronics Inc., Seoul (KR)

( * ) Notice: Subject to any disclaimer, the term of this patent is extended or adjusted under 35 U.S.C. 154(b) by 23 days.

(21) Appl. No.: 11/036,014

(22) Filed: Jan. 18, 2005

(65) Prior Publication Data

US 2005/0223583 A1 Oct. 13, 2005

(30) Foreign Application Priority Data

Apr. 9, 2004 (KR) ..... 10-2004-0024541

(51) Int. Cl.
*F26B 11/02* (2006.01)

(52) U.S. Cl. ..... 34/595; 68/180

(58) Field of Classification Search ..... 34/73, 34/595, 600, 603; 68/180
See application file for complete search history.

(56) References Cited

U.S. PATENT DOCUMENTS 4,204,339 A * 5/1980 Muller ..... 34/75
5,361,511 A * 11/1994 Brown ..... 34/468
5,983,520 A * 11/1999 Kim et al. ..... 34/261
6,006,445 A * 12/1999 Large ..... 34/609
6,748,772 B2 * 6/2004 Lee et al. ..... 68/18 C
6,769,196 B2 * 8/2004 Park et al. ..... 34/77

FOREIGN PATENT DOCUMENTS

KR 10-2002 0028340 4/2002

OTHER PUBLICATIONS

U.S. Appl. No. 10/687,639 to Park et al., filed Oct. 20, 2003.
U.S. Appl. No. 11/032,168 to Hong, filed Jan. 11, 2005.

* cited by examiner

*Primary Examiner*—S. Gravini
(74) *Attorney, Agent, or Firm*—Greenblum & Bernstein, P.L.C.

(57) ABSTRACT

Disclosed herein is a drying unit for washing machines that is capable of fully drying the wet laundry using hot wind. A condensing duct and a drying duct are connected to a tub to circulate air in the tub. Between the drying duct and the condensing duct is disposed a drying fan. To the condensing duct is attached air cooling device for condensing air in the condensing duct by means of cool air. In the drying duct is mounted a drying heater for heating air in the drying duct to change the air into hot wind. During the drying operation of the washing machine, the air passing through the condensing duct is condensed by air, which is an unlimited resource. Consequently, consumption of energy and resources is minimized during the drying operation of the washing machine.

20 Claims, 5 Drawing Sheets

DRYING UNIT FOR WASHING MACHINES

BACKGROUND OF THE INVENTION

1. Field of the Invention

The present invention relates to a drying unit for washing machines that is capable of drying the laundry using hot wind, and, more particularly, to a drying unit for washing machines that is capable of condensing damp air in a tub in an air and water cooling fashion and heating the condensed air by means of a heater to generate hot wind.

2. Description of the Related Art

FIGS. 1 and 2 are views showing a drum washing machine with drying function.

As shown in FIGS. 1 and 2, the washing machine comprises: a cabinet 2 having a door attached to the front part thereof; a tub 4 disposed in the cabinet 2 while being supported by a damper 3; a drum 6 rotatably disposed in the tub 4, the drum 6 having a plurality of water holes 5 formed at the circumferential surface thereof; and a driving unit 10 disposed at the outside of the tub 4, the driving unit 10 being connected to the drum 6 via a rotary shaft for rotating the drum 6.

To the upper part of the tub 4 is connected a water supply pipe 12 for supplying wash water to the tub 4. On the water supply pipe 12 is disposed a water supply valve 14.

The water supply valve 12 is disposed such that the water supply valve passes through a detergent box 16 for containing detergent. If detergent is contained in the detergent box 16, therefore, the detergent in the detergent box 15 is supplied with wash water to the tub 4 when the wash water is supplied through the water supply pipe 12.

To the lower part of the tub 4 is connected a drainage pipe 18 for draining wash water in the tub 4 out of the washing machine. On the drainage pipe 18 is disposed a drainage pump 19.

The drum 6 is provided at the inner wall thereof with lifts 7. Consequently, when the drum 6 is rotated while the laundry is put in the drum 6, the laundry is lifted by the lifts 7, and then falls from the lifts 7 due to gravity.

The washing method of the washing machine with the above-stated construction comprises the steps of: a washing step of removing stain from the laundry; a rinsing step of rinsing the laundry with clean water; and a dewatering step of removing moisture from the laundry, said steps being generally performed in order. Alternatively, the steps may be selectively performed according to user's selection.

The washing machine shown in FIGS. 1 and 2 further comprises a drying unit 20 for forcibly drying the laundry in a short time using hot wind instead of a natural drying process after the laundry is washed.

The conventional drying unit 20 comprises: a condensing duct 22 connected to the lower part of the tub 4; a drying duct 24 connected to the upper part of the tub 4; a blower 26 disposed between the drying duct 24 and the condensing duct 22; a cooling water channel 28 for supplying cooling water into the condensing duct 22; a cooling water valve (not shown) disposed on the cooling water channel 28; and a heater 29 mounted in the drying duct 24.

With the drying unit 20 mounted to the washing machine shown in FIGS. 1 and 2, the washing machine is capable of performing a drying step of forcibly drying the laundry using hot wind.

Specifically, when wet laundry is put in the drum 6, and then the drying step is performed, the blower 26 is operated. As a result, air in the tub 3 passes through the condensing duct 22 and the drying duct 24, and is then supplied again into the tub 4. In this way, the air is circulated. At the same time, cooling water is supplied to the condensing duct 22 through the cooling water channel 28, and the heater 29 is operated.

Consequently, the air in the tub 4, which is damp due to the wet laundry, is blown to the condensing duct 22, where the damp air is condensed by the cooling water. At this time, the cooling water supplied to the condensing duct 22 is introduced into the tub 3, and is then drained out of the washing machine through the drainage pipe 18.

The air condensed in the condensing duct 22 is blown to the drying duct 24, where the condensed air is heated by the heater 29 such that the condensed air is changed into high-temperature and low-humidity hot wind. The hot wind generated in the drying duct 24 is blown to the tub 4 such that the wet laundry put in the drum 6 is dried by the hot wind.

The above-mentioned drying step performed by the drying unit of the washing machine is carried out for several tens of minutes such that the laundry put in the drum 6 is completely dried.

In the conventional drying unit for washing machines, however, the cooling water is continuously supplied to the condensing duct while the drying step is carried out for several tens of minutes, and the cooling water supplied to the condensing duct is drained out of the washing machine through the drainage pipe 18. Consequently, the conventional drying unit for washing machines has a problem in that water consumption is excessive.

SUMMARY OF THE INVENTION

Therefore, the present invention has been made in view of the above problems, and it is an object of the present invention to provide a drying unit for washing machines that is capable of condensing damp air in a tub in an air and water cooling fashion during a drying operation, thereby minimizing consumption of resources, including water.

In accordance with one aspect of the present invention, the above and other objects can be accomplished by the provision of a drying unit for washing machines, comprising: a circulating duct connected between one end of a tub and the other end of the tub; a drying blower connected to the circulating duct for generating a blowing force such that air in the tub is circulated through the circulating duct; an air cooling device for performing heat exchange between air blown from the tub to the circulating duct and external air to condense the blown air; and a drying heater mounted in the circulating duct for heating air condensed by the air cooling device to change air supplied to the tub through the circulating duct into hot wind.

Preferably, the circulating duct comprises: a condensing duct connected between one end of the tub and the drying blower for allowing air blown from the tub to the condensing duct to be condensed by the air cooling device; and a drying duct connected between the other end of the tub and the drying blower, the drying heater being disposed in the drying duct.

Preferably, the air cooling device comprises: an air cooling duct attached to the outside of the condensing duct, the air cooling duct being connected to the outside of the washing machine; and an air cooling blower connected to the air cooling duct for blowing external air into the air cooling duct.

Preferably, the air cooling duct has an opened side connected with the circulating duct.

Preferably, the air cooling blower and the drying blower comprise an air cooling fan and a drying fan rotatable by a driving force of the motor, respectively, and the air cooling fan of the air cooling blower and the drying fan of the drying blower are connected to the motor while being opposite to each other about the motor such that not only the air cooling fan but also the drying fan are rotated by the motor.

Preferably, the air cooling blower is operated to blow external air in the direction opposite to the flow direction of the air passing through the circulating duct.

Preferably, the drying unit for washing machines further comprises: at least one fin disposed between the circulating duct and the air cooling device, the fin being a heat transfer medium.

Preferably, the at least one fin comprises a plurality of fins arranged along the length of the circulating duct.

Preferably, the fin is disposed in the air cooling duct while being attached to one side of the air cooling duct connected with the circulating duct. Alternatively, the fin is disposed across the air cooling duct and the circulating duct.

In accordance with another aspect of the present invention, there is provided a drying unit for washing machines, comprising: a condensing duct connected to one end of the tub; a drying duct connected to the other end of the tub; a drying blower disposed between the drying duct and the condensing duct for generating a blowing force such that air in the tub passes through the condensing duct and the drying duct, and is then supplied to the tub; an air cooling duct attached to the outside of the condensing duct, the air cooling duct being connected to the outside of the washing machine; an air cooling blower connected to the air cooling duct for blowing external air into the air cooling duct such that heat exchange between air passing through the condensing duct and the external air is performed to condense the air passing through the condensing duct; and a drying heater mounted in the drying duct for heating air condensed in the condensing duct to change air supplied to the tub through the drying duct into hot wind.

Preferably, the drying unit for washing machines further comprises: at least one fin disposed between the condensing duct and the air cooling duct, the fin being a heat transfer medium.

Preferably, the at least one fin comprises a plurality of fins arranged along the length of the condensing duct.

Preferably, the fin is disposed in the air cooling duct while being attached to one side of the air cooling duct connected with the circulating duct.

Preferably, the fin is disposed across the air cooling duct and the circulating duct.

Preferably, the air cooling duct has an opened side connected with the condensing duct.

Preferably, the air cooling blower and the drying blower comprise an air cooling fan and a drying fan rotatable by a driving force of the motor, respectively, and the air cooling fan of the air cooling blower and the drying fan of the drying blower are connected to the motor while being opposite to each other about the motor such that not only the air cooling fan but also the drying fan are rotated by the motor.

Preferably, the air cooling blower is operated to blow external air in the direction opposite to the flow direction of the air passing through the condensing duct.

In accordance with yet another aspect of the present invention, there is provided a drying unit for washing machines, comprising: a condensing duct connected to one end of the tub; a drying duct connected to the other end of the tub; a drying fan disposed between the drying duct and the condensing duct for generating a blowing force such that air in the tub passes through the condensing duct and the drying duct, and is then supplied to the tub; an air cooling duct attached to the outside of the condensing duct, the air cooling duct being connected to the outside of the washing machine; at least one fin disposed between the air cooling duct and the condensing duct, the fin being a heat transfer medium; an air cooling fan connected to the air cooling duct for blowing external air into the air cooling duct such that heat exchange between air passing through the condensing duct and the external air is performed to condense the air passing through the condensing duct; a motor disposed between the air cooling fan and the drying fan for rotating not only the air cooling fan but also the drying fan; and a drying heater mounted in the drying duct for heating air condensed in the condensing duct to change air supplied to the tub into hot wind.

Preferably, the air cooling blower is operated to blow external air in the direction opposite to the flow direction of the air passing through the condensing duct.

The drying unit for washing machines with the above-stated construction according to the present invention utilizes air, which is an unlimited resource, to condense damp air passing through the condensing duct using cool air during the drying operation of the washing machine. Consequently, the present invention has an effect of minimizing consumption of energy and resources during the drying operation of the washing machine.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

It should be understood that drying units for washing machines according to numerous preferred embodiments of the present invention may be proposed, although only the most preferred embodiments of the present invention will be described hereinafter. It should also be understood that the basic structure of a washing machine with one of the drying units for washing machines according to the present invention mounted thereto is identical to that of the washing machine with the conventional drying unit for washing machines mounted thereto, and therefore, a detailed description and drawings thereof will not be given.

Figure 1:
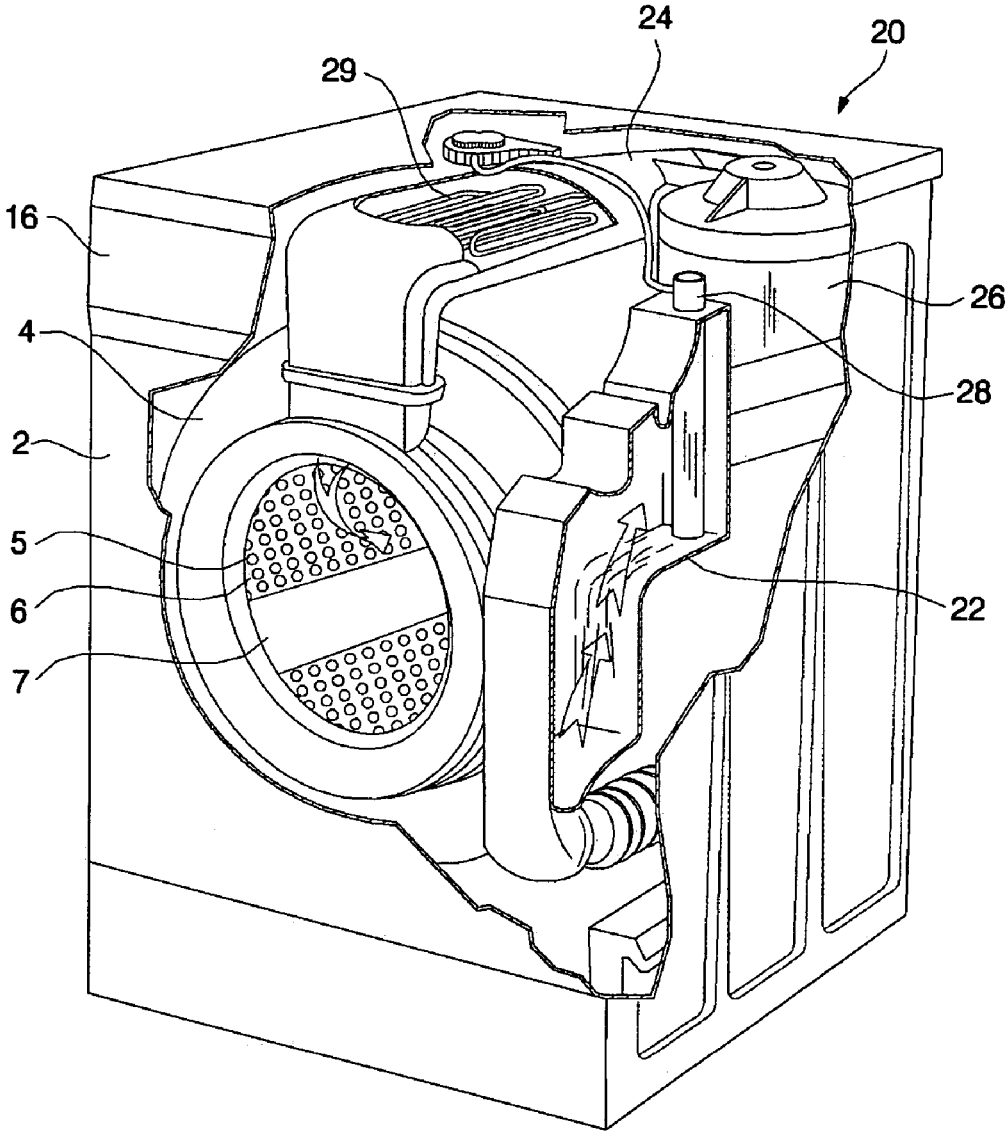
FIG. 1 (Prior Art)
FIG. 1 is a perspective view, partly cutaway, showing a washing machine with a conventional drying unit for washing machines mounted thereto.
Figure 2:
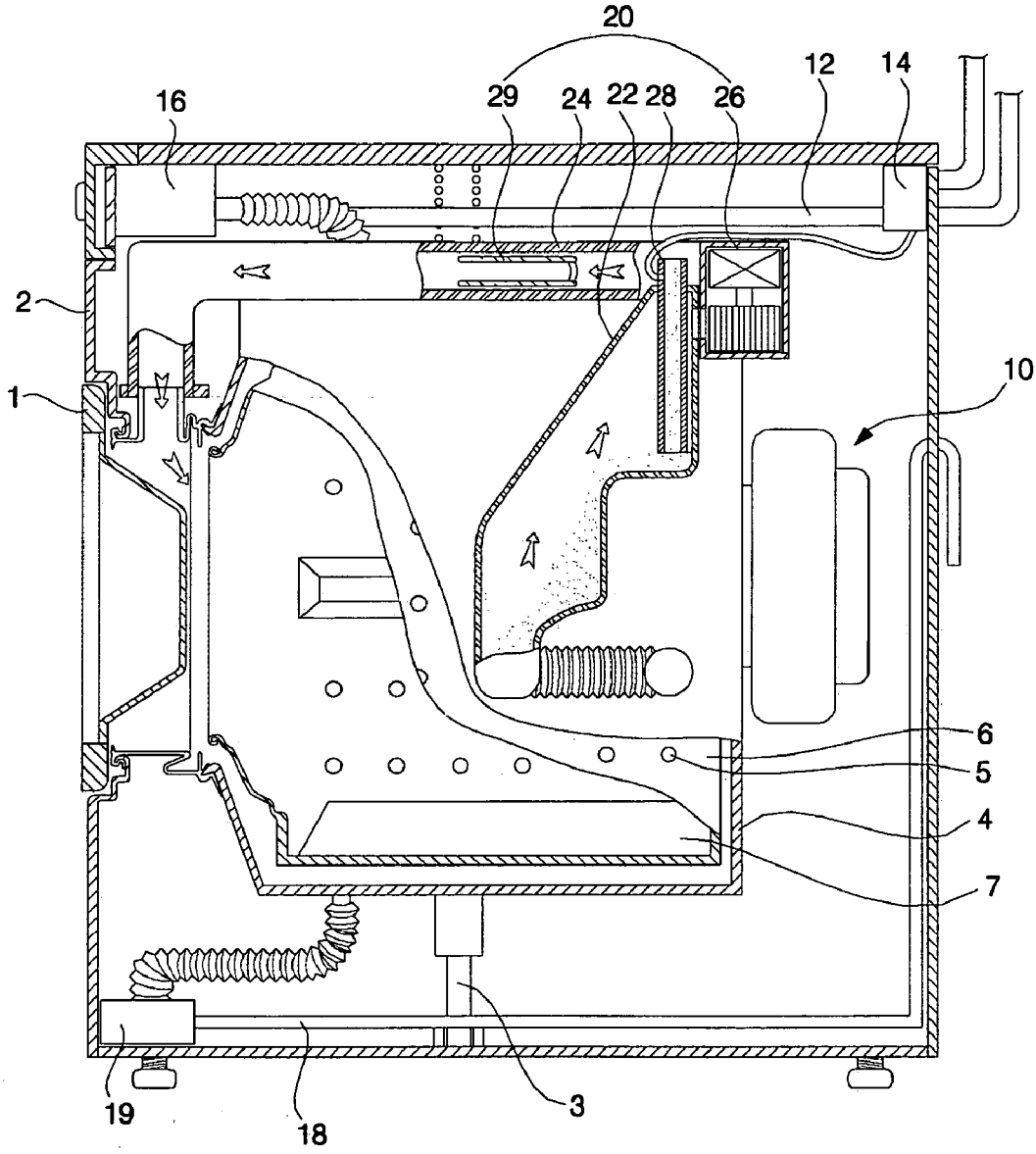
FIG. 2 (Prior Art)
FIG. 2 is a sectional view of the washing machine with the conventional drying unit for washing machines shown in FIG. 1.
Figure 3:
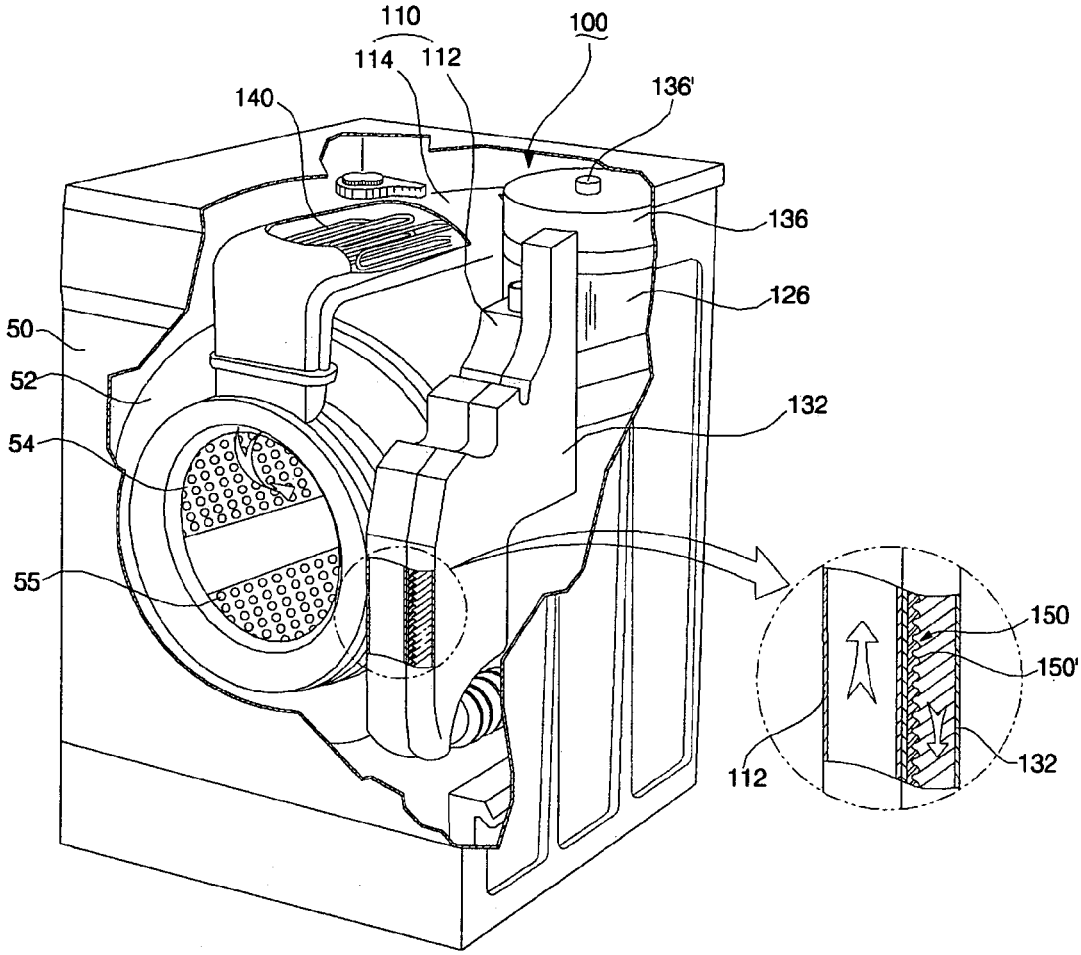
FIG. 3 is a perspective view, partly cutaway, showing a washing machine with a drying unit for washing machines according to a first preferred embodiment of the present invention mounted thereto.
Figure 4:
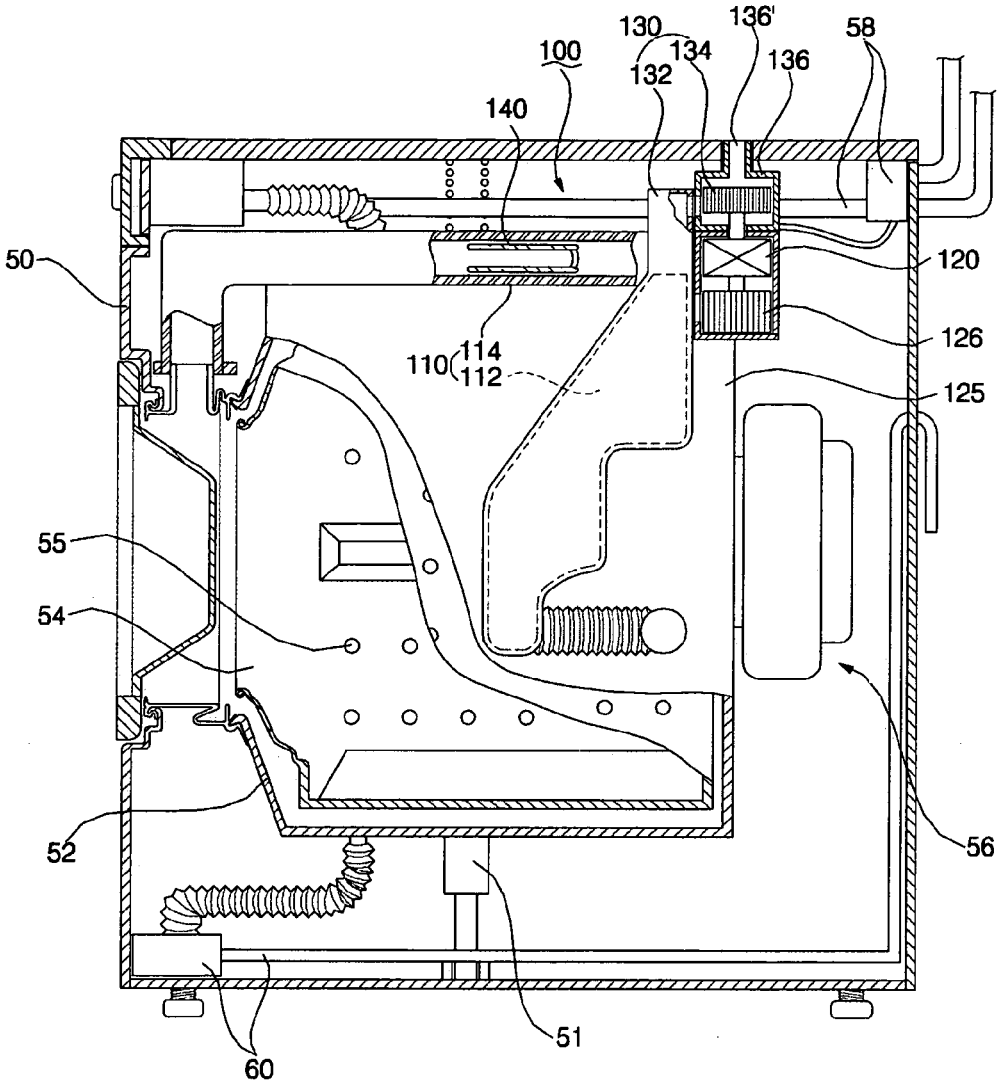
FIG. 4 is a sectional view of the washing machine with the drying unit for washing machines according to the first preferred embodiment of the present invention shown in FIG. 3 illustrating the structure of the drying unit.

FIGS. 3 and 4 show a drying unit for washing machines according to a first preferred embodiment of the present invention.

The washing machine with the drying unit for washing machines according to the first preferred embodiment of the present invention comprises: a tub 52 disposed in a cabinet 50 while being supported by a damper 51; a drum 54 rotatably disposed in the tub 52, the drum 54 having a plurality of water holes 55 formed at the circumferential surface thereof; a driving unit 56 for rotating the drum 54; a water supply unit 58 for supplying wash water to the tub 52; a drainage unit 60 for draining wash water in the tub out of the washing machine; and a drying unit 100 for supplying hot wind to the tub 52 so as to forcibly dry the laundry put in the drum 54.

The drying unit 100 comprises: a circulating duct 110 connected between one end of the tub 52 and the other end of the tub 52; a drying fan 125 connected to the circulating duct 110, the drying fan 125 being rotated by the motor 120 for generating a blowing force into the circulating duct 110; air cooling device 130 for performing heat exchange between air blown from the tub 52 to the circulating duct 110 and external air to condense the blown air; and a drying heater 140 disposed in the circulating duct 110 for heating air in the circulating duct 110, condensed by the air cooling device 130.

The circulating duct 110 comprises: a condensing duct 112 connected between the lower part of the tub 52 and the drying fan 125, the condensing duct 112 being connected to the air cooling device 130; and a drying duct 114 connected between the upper part of the tub 52 and the drying fan 125, the drying heater 140 being disposed in the drying duct 114.

Preferably, the condensing duct 112 is made of a metal material having high thermal conductivity such that heat exchange is satisfactorily performed between the condensing duct 112 and the air cooling device 130. Alternatively, the condensing duct 112 may be formed of a plastic material based on design conditions of the condensing duct.

The motor 120 is disposed in the upper part of a drying blower case 126 disposed on the tub 52 while being connected to the condensing duct 112 and the drying duct 114.

The drying fan 125 is rotatably disposed in the lower part of the drying blower case 126 while being connected to the motor 120. The drying fan 125 is rotated by the driving force of the motor 120 for blowing air in the tub 52 to above the tub 52 through the condensing duct 112 and the drying duct 114.

The air cooling device 130 comprises: an air cooling duct 132 attached to the outside of the condensing duct 112, the air cooling duct 132 being connected to the outside of the washing machine; and an air cooling fan 134 rotatable by the driving force of the motor 120 for blowing external air into the air cooling duct 132.

The air cooling duct 132 is made of a metal material having high thermal conductivity such that heat exchange is satisfactorily performed between the air cooling duct 132 and the condensing duct 112. The air cooling duct 132 is disposed parallel with the condensing duct 112 while being in contact with one side of the condensing duct 112.

The air cooling fan 134 is rotatably disposed in an air cooling blower case 136 connected to the air cooling duct 132 and the outside of the washing machine. As the air cooling fan 134 is rotated, external air is blown to the air cooling duct 132 in the direction opposite to the flow direction of the air passing through the condensing duct 112.

The air cooling blower case 136 is provided with a ventilation hole 136', through which the air cooling duct 132 is connected to the outside of the washing machine, and external air is blown to the air cooling duct 132.

Preferably, the air cooling blower case 136 is disposed in line with the drying blower case 126 such that the air cooling fan 134 and the drying fan 125 are connected to the motor 120.

Consequently, the air cooling blower case 136 is disposed on the top of the drying blower case 126, and the air cooling fan 134 and the drying fan 125 are disposed vertically while being opposite to each other about the motor 120 such that the air cooling fan 134 and the drying fan 125 are connected to the motor 120. The motor 120 has two shafts connected to the air cooling fan 134 and the drying fan 125, respectively.

Between the condensing duct 112 and the air cooling duct 132 is disposed at least one fin 150, which is a heat transfer medium for performing a satisfactory heat exchange between the condensing duct 112 and the air cooling duct 132.

The fin 150 is disposed in the air cooling duct 132 while being attached to one side of the air cooling duct 132, which is connected with the condensing duct 112.

The fin 150 is made of a metal material having high thermal conductivity. Preferably, a plurality of fins 150 may be arranged along the length of the condensing duct 112. The fins 150 have uneven surfaces 150', which contact air passing through the air cooling duct 132, to maximize the heat exchange area.

The drying operation of the drying unit for washing machines with the above-stated construction according to the present invention will be described.

When the wet laundry is put in the drum 54, and the washing machine is operated to perform the drying operation, the drying fan 125 is operated by the motor 120. As a result, air in the tub 52 passes through the condensing duct 112, the drying blower case 126, and the drying duct 114, and is then supplied again into the tub 52.

The air cooling fan 134 is operated by the motor 120. As a result, external air is blown to the air cooling duct 132 through the air cooling blower case 136. The drying heater 140 is also operated.

Consequently, the air in the tub 52, which is damp due to the wet laundry, is blown to the condensing duct 112 by a blowing force of the drying fan 125 such that the air is condensed by air passing through the air cooling duct 132 in the condensing duct 112.

Specifically, when external cool air passes through the air cooling duct 132 by the air cooling fan 134, heat exchange is performed between the air passing through the condensing duct 112 and the air passing through the air cooling duct 132. As a result, the air passing through the condensing duct 112 is condensed. The fin 150, which is a heat transfer medium, is provided at the air cooling duct 132. Consequently, more smooth heat exchange between the air cooling duct 132 and the condensing duct 112 is performed.

Condensed water, which is produced by condensing air passing through the condensing duct 112, is drained out of the washing machine through the tub 52 and the drainage unit 60.

When the air is condensed in the condensing duct 112 as described above, the condensed air is blown to the drying duct 114 through the drying blower case 126 by a blowing force of the drying fan 125.

The condensed air blown to the drying duct 114 is heated by the drying heater 140. As a result, the condensed air is changed into high-temperature and low-humidity hot wind. The hot wind generated in the drying duct 114 is blown to the tub 52 by the blowing force of the drying fan 125 to dry the laundry put in the drum 54.

Now, other preferred embodiments of the present invention will be described, which are identical in technical concept and basic structure to the first preferred embodiment of the present invention previously described with reference to FIGS. 3 and 4. Therefore, detailed descriptions and drawings of other preferred embodiments of the present invention will not be given.

Figure 5:
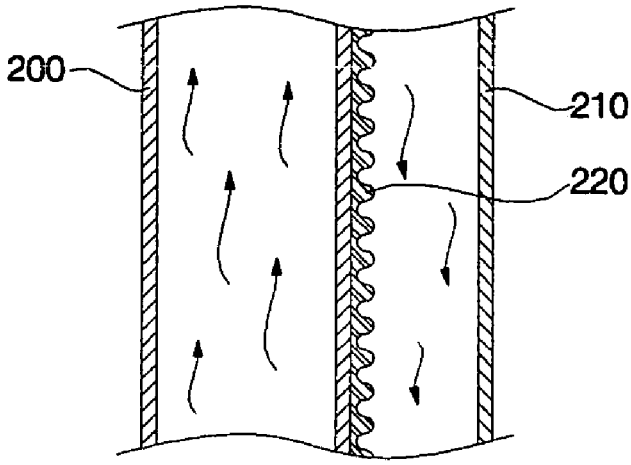
FIG. 5 is a sectional view showing the structure of principal components of a drying unit for washing machines according to a second preferred embodiment of the present invention.

FIG. 5 is a sectional view showing the structure of principal components of a drying unit for washing machines according to a second preferred embodiment of the present invention.

In the drying unit for washing machines according to the second preferred embodiment of the present invention shown in FIG. 5, an air cooling duct 210, through which cool air passes, is disposed parallel with a condensing duct 200 such that air passing through the condensing duct 200 is condensed by the cool air passing through the air cooling duct 210. Especially, one side of the air cooling duct 210, which is connected with the condensing duct 200, is opened to perform smooth heat exchange between the condensing duct 200 and the air cooling duct 210. At the opened side of the air cooling duct 210 are disposed fins 220, which are heat transfer media for facilitating heat exchange between the condensing duct 200 and the air cooling duct 210.

The fins 220 are fixed to the air cooling duct 210 such that the opened side of the air cooling duct 210 is fully covered with the fins 220. Consequently, the fins 220 are in direct contact with the outer wall of the condensing duct 200.

Figure 6:
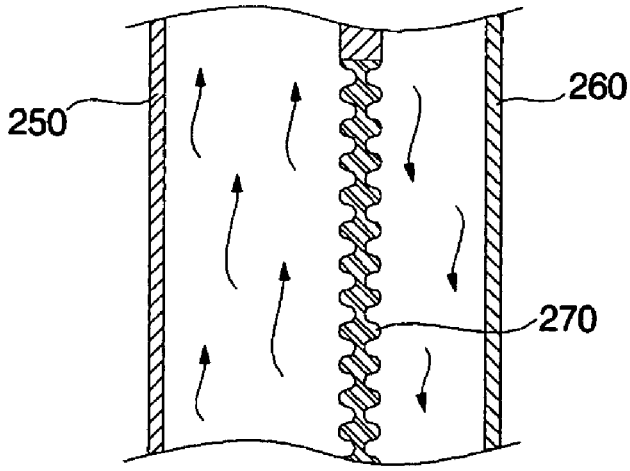
FIG. 6 is a sectional view showing the structure of principal components of a drying unit for washing machines according to a third preferred embodiment of the present invention.

FIG. 6 is a sectional view showing the structure of principal components of a drying unit for washing machines according to a third preferred embodiment of the present invention.

In the drying unit for washing machines according to the third preferred embodiment of the present invention shown in FIG. 6, an air cooling duct 260, through which cool air passes, is disposed parallel with a condensing duct 250 such that air passing through the condensing duct 250 is condensed by the cool air passing through the air cooling duct 260. Especially, one side of the condensing duct 250, which is adjacent to the air cooling duct 260, and one side of the air cooling duct 260, which is adjacent to the condensing duct 250, are opened to perform smooth heat exchange between the condensing duct 250 and the air cooling duct 260. Between the opened side of the condensing duct 250 and the opened side of the air cooling duct 260 are disposed fins 270, which are heat transfer media for facilitating heat exchange between the condensing duct 250 and the air cooling duct 260.

In this structure, the fins 270 directly contact the air passing through the condensing duct 250 and the air passing through the air cooling duct 260 at both sides thereof. Preferably, both sides of the fins 270 are uneven to perform more smooth heat exchange between the condensing duct 250 and the air cooling duct 260.

As apparent from the above description, the drying unit for washing machines according to the present invention utilizes air, which is an unlimited resource, to condense damp air passing through the condensing duct using cool air during the drying operation of the washing machine. Consequently, the present invention has an effect of minimizing consumption of energy and resources during the drying operation of the washing machine.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A drying unit for washing machines, comprising:

a circulating duct connected between one end of a tub and the other end of the tub;

a drying blower connected to the circulating duct for generating a blowing force such that air in the tub is circulated through the circulating duct;

an air cooling device for performing heat exchange between air blown from the tub to the circulating duct and external air to condense the blown air; and a drying heater mounted in the circulating duct for heating air condensed by the air cooling device to change air supplied to the tub through the circulating duct into hot wind, wherein the circulating duct comprises:

a condensing duct connected to one end of the tub to allow air blown from the tub to be condensed by the air cooling device; and a drying duct connected to the other end of the tub to allow air blown from the condensing duct to be heated, wherein the air cooling device comprises an air cooling duct attached to the outside of the condensing duct to allow external air to be passed, and wherein the drying blower is disposed between the drying duct and the condensing duct.

2. The unit as set forth in claim 1, wherein the air cooling device further comprises:

an air cooling blower connected to the air cooling duct for blowing external air into the air cooling duct.

3. The unit as set forth in claim 2, wherein the air cooling duct has an opened side connected with the circulating duct.

4. The unit as set forth in claim 2, wherein the air cooling blower and the drying blower comprise an air cooling fan and a drying fan rotatable by a driving force of the motor, respectively, and the air cooling fan of the air cooling blower and the drying fan of the drying blower are connected to the motor while being opposite to each other about the motor such that not only the air cooling fan but also the drying fan are rotated by the motor.

5. The unit as set forth in claim 2, wherein the air cooling blower is operated to blow external air in the direction opposite to the flow direction of the air passing through the circulating duct.

6. The unit as set forth in claim 1, further comprising:

at least one fin disposed between the circulating duct and the air cooling device, the fin being a heat transfer medium.

7. The unit as set forth in claim 6, wherein the at least one fin comprises a plurality of fins arranged along the length of the circulating duct.

8. The unit as set forth in claim 6, wherein the fin is disposed in the air cooling duct while being attached to one side of the air cooling duct connected with the circulating duct.

9. The unit as set forth in claim 6, wherein the fin is disposed across the air cooling duct and the circulating duct.

10. A drying unit for washing machines, comprising:

a condensing duct connected to one end of the tub;

a drying duct connected to the other end of the tub;

a drying blower disposed between the drying duct and the condensing duct for generating a blowing force such that air in the tub passes through the condensing duct and the drying duct, and is then supplied to the tub;

an air cooling duct attached to the outside of the condensing duct, the air cooling duct being connected to the outside of the washing machine;

an air cooling blower connected to the air cooling duct for blowing external air into the air cooling duct such that heat exchange between air passing through the condensing duct and the external air is performed to condense the air passing through the condensing duct; and a drying heater mounted in the drying duct for heating air condensed in the condensing duct to change air supplied to the tub through the drying duct into hot wind.

11. The unit as set forth in claim 10, further comprising:

at least one fin disposed between the condensing duct and the air cooling duct, the fin being a heat transfer medium.

12. The unit as set forth in claim 11, wherein the at least one fin comprises a plurality of fins arranged along the length of the condensing duct.

13. The unit as set forth in claim 11, wherein the fin is disposed in the air cooling duct while being attached to one side of the air cooling duct connected with the condensing duct.

14. The unit as set forth in claim 11, wherein the fin is disposed across the air cooling duct and the condensing duct.

15. The unit as set forth in claim 10, wherein the air cooling duct has an opened side connected with the condensing duct.

16. The unit as set forth in claim 10, wherein the air cooling blower and the drying blower comprise an air cooling fan and a drying fan rotatable by a driving force of the motor, respectively, and the air cooling fan of the air cooling blower and the drying fan of the drying blower are connected to the motor while being opposite to each other about the motor such that not only the air cooling fan but also the drying fan are rotated by the motor.

17. The unit as set forth in claim 10, wherein the air cooling blower is operated to blow external air in the direction opposite to the flow direction of the air passing through the condensing duct.

18. A drying unit for washing machines, comprising:

a condensing duct connected to one end of the tub;

a drying duct connected to the other end of the tub;

a drying fan disposed between the drying duct and the condensing duct for generating a blowing force such that air in the tub passes through the condensing duct and the drying duct, and is then supplied to the tub;

an air cooling duct attached to the outside of the condensing duct, the air cooling duct being connected to the outside of the washing machine;

at least one fin disposed between the air cooling duct and the condensing duct, the fin being a heat transfer medium;

an air cooling fan connected to the air cooling duct for blowing external air into the air cooling duct such that heat exchange between air passing through the condensing duct and the external air is performed to condense the air passing through the condensing duct;

a motor disposed between the air cooling fan and the drying fan for rotating not only the air cooling fan but also the drying fan; and a drying heater mounted in the drying duct for heating air condensed in the condensing duct to change air supplied to the tub into hot wind.

19. The unit as set forth in claim 18, wherein the air cooling blower is operated to blow external air in the direction opposite to the flow direction of the air passing through the condensing duct.

20. The unit as set forth in claim 1, wherein the air cooling duct is attached to the outside of the condensing duct such that external air passes through the air cooling duct in the opposite direction to the flow direction of the air passing through the condensing duct.

* * * * *